US005812913A

United States Patent [19]

Morris et al.

[11] Patent Number: 5,812,913

[45] Date of Patent: Sep. 22, 1998

[54] METHOD AND APPARATUS TO DRY MEDIA DURING ELECTROSTATIC PRINTING

[75] Inventors: Terry L. Morris, Eagan; Thomas A. Speckhard, Cottage Grove, both of Minn.; Yoshinori Akichika, Yokohama, Japan; Kenneth D. Wilson, Stillwater Township; Michael E. Kaszynski, Inver Grove Heights, both of Minn.

[73] Assignee: Minnesota Mining And Manufacturing Company, St. Paul, Minn.

[21] Appl. No.: 779,161

[22] Filed: Jan. 6, 1997

[51] Int. Cl.[6] ..... G03G 15/10

[52] U.S. Cl. ..... 399/251; 399/348

[58] Field of Search ..... 399/251, 348; 34/653; 358/300; 430/97, 117

[56] References Cited

U.S. PATENT DOCUMENTS

| | | | |
|---|---|---|---|
| Re. 35,049 | 10/1995 | Atherton et al. | 346/135.1 |
| 3,579,853 | 5/1971 | Martino | 34/160 |
| 3,780,376 | 12/1973 | Pressman et al. | 358/300 X |
| 4,469,026 | 9/1984 | Irwin | 101/426 |
| 4,531,824 | 7/1985 | Landa | 399/156 |
| 4,723,147 | 2/1988 | Dyer | 399/251 |
| 4,731,542 | 3/1988 | Doggett | 250/548 |
| 4,734,788 | 3/1988 | Emmett et al. | 358/300 |
| 4,965,137 | 10/1990 | Ruf | 428/432 |
| 5,025,292 | 6/1991 | Steele | 399/233 |
| 5,045,391 | 9/1991 | Brandt et al. | 428/336 |
| 5,063,413 | 11/1991 | Domoto et al. | 399/249 |
| 5,192,613 | 3/1993 | Work, III et al. | 428/363 |
| 5,200,285 | 4/1993 | Carrish | 430/45 |
| 5,269,970 | 12/1993 | Ruf et al. | 252/518 |
| 5,400,126 | 3/1995 | Cahill et al. | 399/307 |
| 5,420,673 | 5/1995 | Itoh | 399/251 |
| 5,552,869 | 9/1996 | Schilli et al. | 399/251 |
| 5,557,377 | 9/1996 | Loewen et al. | 399/182 |
| 5,604,990 | 2/1997 | Takekoshi | 34/68 |

FOREIGN PATENT DOCUMENTS

| | | |
|---|---|---|
| 57-2946 | 1/1982 | Japan . |
| 57-2948 | 1/1982 | Japan . |

*Primary Examiner*—Nestor Ramirez
*Attorney, Agent, or Firm*—Gary L. Griswold; Walter N. Kirn; John H. Hornickel

[57] ABSTRACT

A method and apparatus to improve toner drying on electrostatic printing media is disclosed. A drying apparatus placed between two print stations in a single pass electrostatic printer provides air from two different drying assemblies, one adjacent to one print station and a second adjacent to a second print station.

20 Claims, 1 Drawing Sheet

METHOD AND APPARATUS TO DRY MEDIA DURING ELECTROSTATIC PRINTING

FIELD OF THE INVENTION

This invention relates to a method and apparatus to dry electrostatic, dielectric printing media during printing of such media.

BACKGROUND OF THE INVENTION

Electrostatic color printers or plotters operate by passing a print medium, e.g., specially-coated paper or plastic film, across one or more charging heads. The charging heads apply a negative charge to the print medium in the pattern of the desired printed image. Subsequently, a liquid toner is applied to the print medium and the toner adheres to the negative charged patterns. Excess toner is removed by a vacuum chamber or roller.

Electrostatic printers are constructed in several ways. In a multi-pass system (e.g., an 8900 series electrostatic printer from Xerox Engineering Systems, San Jose, Calif.), a single charging head is used in association with a series of toner stations (typically four for the colors, yellow, cyan, magenta, and black). In the multi-pass system, print medium is transported across the charging head and then one of the toner stations to apply the color toner of that particular station. The print medium is then rewound and passed across the charging head and a different toner station for each color to be applied to the print medium.

Another electrostatic printer is the single-pass printer (e.g., a Scotchprint™ Model 9512 from 3M, St. Paul, Minn.). In the single-pass system, the printer has charging heads associated with each of the toner stations. The print medium is then passed across each pair of charging heads and toner stations to apply all of the colors. Another example of the single-pass system is found in U.S. Pat. No. 4,734,788.

In both types of electrostatic printers, single-pass and multi-pass, the same basic design criteria apply, including the speed of printing, toner optical density after printing, residual voltage or charge on the print medium, and media compatibility. In the past, electrostatic printers were used primarily in engineering applications where relatively low print speeds were acceptable. However, electrostatic printers are now being used in a wider variety of applications and customers are demanding faster printing speeds, typically measured in inches per second. An increased printing speed impacts the other design criteria, including necessary toner density, residual voltage requirements, and media compatibility.

As the market demands faster printing speeds, the engineering of electrostatic printers must also change.

SUMMARY OF THE INVENTION

This present invention solves how faster printing speeds will not complicate the process of toner deposition on media surfaces before the media is subsequently charged and toned in a single pass printer.

One aspect of the invention is a drying apparatus for an electrostatic printer, comprising a first means for directing air to a print medium moving between an upstream print station and a downstream print station, and a second means for directing air to the medium moving between the same two print stations, wherein the first means is downstream from the upstream print station and the second means is upstream from the downstream print station and wherein the first means and the second means direct air at different angles.

Another aspect of the invention is a method for drying toner on an electrostatic printing medium, comprising the steps of directing air from an air supply to the medium through a first distribution vent located between two print stations and directing air from a same or different air supply through a second distribution vent located between the same two print stations and wherein the first means and the second means direct air at different angles.

One advantage of the apparatus and method of the present invention is that they solve drying problems in fast speed electrostatic printer.

Another advantage is that the apparatus of the present invention can be added to existing electrostatic printers or plotters or incorporated into new printers or plotters without excessive effort or cost.

Another advantage of the method and apparatus of the present invention is that the printing equipment can operate at acceptable speeds without undue undried toner on a printing medium as that medium passes a subsequent print station.

Further advantages of the invention are found in the embodiments of the invention, described with reference to the following drawings.

EMBODIMENTS OF THE INVENTION

Figure 1:
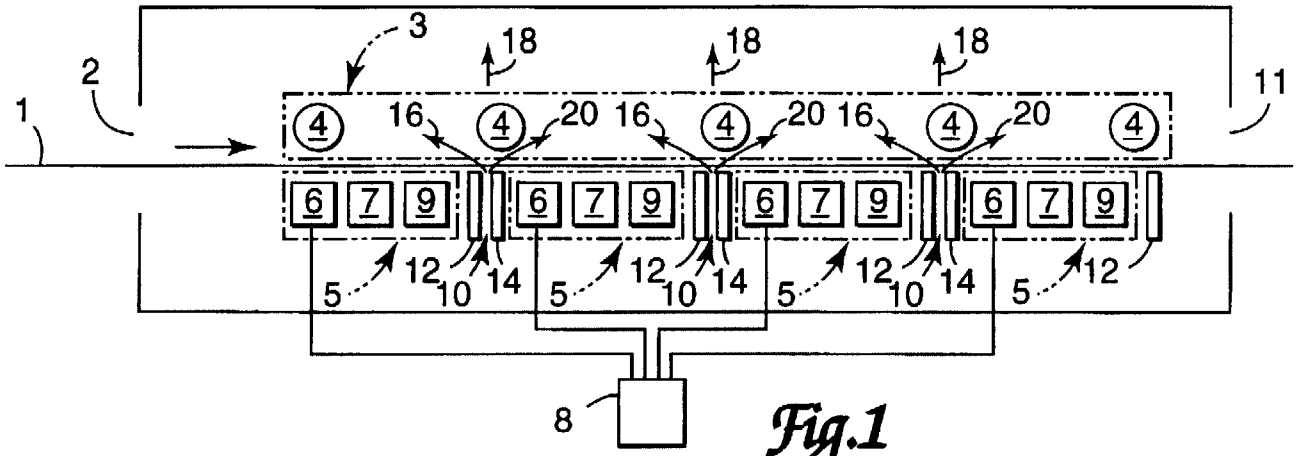
FIG. 1 is a block diagram of a single-pass printer from a side perspective.

FIG. 1 is a block diagram of a single-pass printer from a side perspective. Print medium 1 enters the printer via inlet 2. Print medium 1 is directed through the printer by a transport assembly 3. As shown in FIG. 1, transport assembly 3 typically comprises a series of rollers 4 and associated lateral guides (not shown). The print medium is transported across consecutive printing stations 5.

Each printing station 5 includes an electrostatic charging head 6 and toner station 7. In a printer that applies the four basic colors (cyan, magenta, yellow, and black), there are four printing stations 5, each station applying one of the four colors to the print medium.

Each of the charging heads 6 are programmed by controller 8. Controller 8 determines the precise pattern of charge applied by each charging head 6 to the print medium 1.

Each print station 5 may also include a toner removal device 9, which may include a vacuum system, a scraper, and/or roller.

The drying apparatus 10 of the present invention comprises a conventional drying assembly 12 along the print medium path after each print station 5 and an additional drying assembly 14 along the print medium path prior to the next print station 5.

Each assembly 12 is contiguous to and downstream from an upstream print station 5. Each assembly 14 is contiguous to and upstream from an downstream print station 7.

The pair of assemblies 12 and 14 comprising the drying apparatus 10 of the present invention can be placed between any two print stations 5. As seen in FIG. 1, the drying apparatus 10 can be placed in the maximum number of locations between adjacent print stations 5 if toner for each color so requires such drying capacity for electrostatic printing operating at speeds exceeding two inches/sec (ips) (five cm/sec). Otherwise, drying apparatus 10 can be positioned only downstream of print stations 5 that have toners which have unusual drying requirements. For example, a drying apparatus 10 can be placed downstream of the magenta print station 5 if magenta toner contains difficult-to-dry toner even though the cyan, yellow, and black toners are not difficult to dry.

After passing across all of the print stations 5, the print medium exits the printer at outlet 11.

Figure 2:
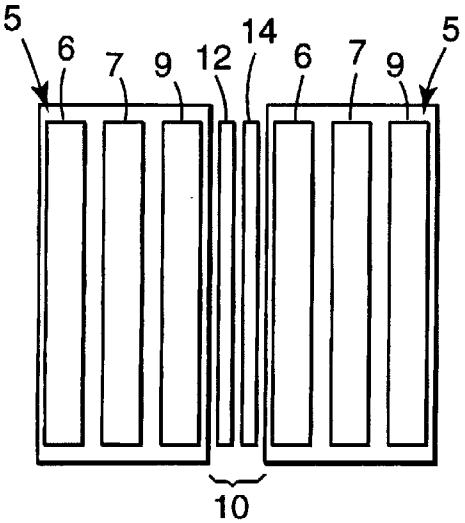
FIG. 2 is a block diagram of two print stations of a single-pass printer and a drying apparatus from a top perspective.

As seen in FIG. 2, a block diagram from the top perspective, the drying apparatus 10 of the present invention extends across the width of a toner removal device 9 and between two printing stations 5 with assembly 12 associated with the upstream print station 5 and assembly 14 associated with the downstream print station 5 with separation between the assemblies 12 and 14.

Drying assembly 12 can be any conventional drying vent providing ambient air, recycled air, dry air, or heated air to the surface of the medium 1 after a toner station 7 has deposited toner and a toner removal device 9 has removed excess toner. The vent can provide from about 2880 to about 14,400 $cm^3$/sec. (100–500 $ft^3$/min.) over the width of medium 1 passing the vent. That volume of air can be delivered through a vent having an opening of about 0.5 cm to about 0.8 cmin the direction of media movement. When considering the width of the vent of about 1.3 m, the vent opening has an area of about 100 $cm^2$.

The direction of air flow from assembly 12 can be any angle from directly counter to the direction of medium movement to directly with that direction. Preferably, the direction 16 of air flow for assembly 12 is at an angle of from about 60° from an axis 18 perpendicular to medium movement to about 120°.

Drying assembly 12 can be manufactured to provide a manifold airflow through its vent with air flow being provided by a series of blowers commercially available from a number of sources, including Japan Servo Co. Ltd. which sells a DC CB Blower III operating at 11 watts and 24 volts DC. To provide a uniform volume of air across the 1.3 m width of assembly 12, as many as nine blowers can be spaced in a line along that width within the assembly 12.

Drying assembly 14 can be any conventional drying vent providing ambient or heated air to the surface of the medium 1 after a toner station 7 has deposited toner and a toner removal device 9 has removed excess toner. The vent can provide from about 2880 to about 14,400 $cm^3$/sec. (100–500 $ft^3$/min.) over the width of medium 1 passing the vent. That volume of air can be delivered through a vent having an opening of about 0.5 cm to about 0.8 cmin the direction of media movement. When considering the width of the vent of about 1.3 m, the vent opening has an area of about 100 $cm^2$.

The direction of air flow from assembly 14 can be any angle from directly counter to the direction of medium movement to directly with that direction. Preferably, the direction 20 of air flow for assembly 12 is at an angle of about 60° from an axis perpendicular to medium movement to about 120°.

Drying assembly 14 can be constructed from the same components and blowers as used for assembly 12.

Drying assembly 14 is distinguished from drying assembly 12 because drying assembly 14 is associated with the next downstream print station 5 while drying assembly is contiguous to the preceding upstream print station 5.

Direction of air flows from assembly 12 and assembly 14 can be the same or different. If the same, the air flows can be counter-current to the direction of the medium 1 or can be co-current to the direction of the medium 1. If different, the air flows provide two different directions of drying force for medium 1 in the space of about 6 cm and in the duration of about one second. Different angles of air flows from assemblies 12 and 14 are preferred,as seen for example, in FIG. 1 for air directions 16 and 2 compared with 18.

Unexpectedly, a separation of assembly 12 from 14 greatly assists the drying of toner on medium 1, especially when the angles of air flow from assemblies 12 and 14 are different. Preferably, the separation can range from about 0.5 cm to about 6.5 cm. At such distance, medium passes assembly 14 approximately within one second after passing assembly 12, when the printer is operating at 2.0 ips. The separation is unexpectedly superior to a single drying assembly 12 having an increased air flow volume matching the total of air flow volumes from assemblies 12 and 14 because multiple air flows provide greater duration of air contact with medium 1.

Printing medium 1 that particularly benefits from the drying apparatus 10 of the present invention is a dielectric printing sheet disclosed in U.S. Pat. No. 5,045,391 (Brandt et al.) or disclosed in U.S. Pat. No. 5,400,126 (Cahill et al.) or a polymeric medium, such as that disclosed in U.S. Pat. Nos. Re. 35,049(Atherton et al.); 4,965,137 (Ruf); 5,192,613 (Work, III et al.); and 5,269,970 (Ruf et al.); and copending, coassigned U.S. patent application Ser. No. 08/581,324.

Drying apparatus 10 can be installed in new equipment or retrofitted into existing electrostatic printing equipment as a single module of assemblies 12 and 14 or as discrete components. Retrofitting may only require assembly 14 to complete a drying apparatus according to the present invention.

Nonlimiting examples of commercially available or commercially advertised electrostatic printers that can employ at least one drying apparatus 10 of the present invention include a Scotchprint Model 9510 or 9512 printer commercially available from Minnesota Mining and Manufacturing Company (3M) of St. Paul, Minn. or a Scotchprint 2000 printer commercially advertised by 3M.

The invention is not limited to the above embodiments. The claims follow.

What is claimed is:

1. A drying apparatus for an electrostatic printer, comprising a first means for directing air to one side of a print medium moving between an upstream print station and a downstream print station, wherein the first means is disposed between the two print stations and a second means for directing air to the one side of the medium the second means also disposed between the same two print stations, wherein the first means is downstream from the upstream print station and the second means is upstream from the downstream print station and wherein the first means and the second means direct air at different angles.

2. The apparatus of claim 1, wherein the first means comprises a first drying assembly contiguous the upstream print station and the second means comprises a second drying assembly contiguous the downstream print station.

3. The apparatus of claim 2, wherein the first drying assembly and the second drying assembly are separated over a space ranging from about 0.5 cm to about 6.5cm.

4. The apparatus of claim 2, wherein the first drying assembly directs air at an angle ranging from directly counter to the direction of medium movement to directly with the direction of medium movement, and wherein the second drying assembly directs air at an angle ranging from directly counter to the direction of medium movement to directly with the direction of medium movement.

5. The apparatus of claim 4, wherein the angle for the first drying assembly ranges from about 60° from an axis perpendicular to medium movement to about 120°, and wherein the angle for the second drying assembly ranges from about 60° from an axis perpendicular to medium movement to about 120°.

6. The apparatus of claim 2, wherein the first drying assembly and the second drying assembly direct ambient air.

7. The apparatus of claim 2, wherein the first drying assembly and the second drying assembly direct heated air.

8. The apparatus of claim 2, wherein the first drying assembly and the second drying assembly direct recycled air.

9. The apparatus of claim 2, wherein the first drying assembly and the second drying assembly direct dry air.

10. The apparatus of claim 1, wherein the first means directs air at an angle ranging from directly counter to the direction of medium movement to directly with the direction of medium movement, and wherein the second means directs air at an angle ranging from directly counter to the direction of medium movement to directly with the direction of medium movement.

11. The apparatus of claim 10, wherein the angle for the first means ranges from about 60° from an axis perpendicular to medium movement to about 120°, and wherein the angle for the second means ranges from about 60° from an axis perpendicular to medium movement to about 120°.

12. The apparatus of claim 1, wherein the first means and the second means direct ambient air.

13. The apparatus of claim 1, wherein the first means and the second means direct heated air.

14. The apparatus of claim 1, wherein the first means and the second means direct recycled air.

15. The apparatus of claim 1, wherein the first means and the second means direct dry air.

16. A method for drying toner on an electrostatic printing medium, comprising the steps of:

(a) directing air from an air supply to one side of the medium through a first distribution vent located between two print stations, and (b) directing air from a same or different air supply through a second distribution vent located between the same two print stations to the one side of the medium, wherein the first distribution vent and the second distribution vent direct air at different angles.

17. The method of claim 16, wherein the first distribution vent and the second distribution vent are separated at a distance from about 0.5 cm to about 6.5 cm and whereby medium passes the second distribution vent about one second after passing the first distribution vent.

18. The method of claim 16, wherein the first step directs ambient air, recycled air, dry air, or heated air to the one side of the printing medium.

19. The method of claim 16, wherein the second step directs ambient air, recycled air, dry air, or heated air to the one side of the printing medium.

20. The method of claim 16, wherein the first distribution vent directs air at an angle ranging from directly counter to the direction of medium movement to directly with the direction of medium movement, and wherein the second distribution vent directs air at an angle ranging from directly counter to the direction of medium movement to directly with the direction of medium movement.

* * * * *

UNITED STATES PATENT AND TRADEMARK OFFICE

CERTIFICATE OF CORRECTION

PATENT NO.: 5,812,913

DATED: September 22, 1998

INVENTOR(S): Terry L. Morris; Thomas A. Speckhard; Yoshinori Akichika; Kenneth D. Wilson; Michae E. Kaszynski It is certified that error appears in the above-identified patent and that said Letters Patent is hereby corrected as shown below:

On the title page:

Under Assignee, also include --Nippon Steel Corporation, Tokyo, Japan – as second assignee Signed and Sealed this Thirty-first Day of August, 1999

*Attest:*

*Attesting Officer*

Q. TODD DICKINSON

*Acting Commissioner of Patents and Trademarks*